US009370800B2

(12) United States Patent
St-Pierre

(10) Patent No.: US 9,370,800 B2
(45) Date of Patent: Jun. 21, 2016

(54) BIOREMEDIATION DEVICE

(76) Inventor: Jacques St-Pierre, Sherbrooke (CA)

( * ) Notice: Subject to any disclaimer, the term of this patent is extended or adjusted under 35 U.S.C. 154(b) by 999 days.

(21) Appl. No.: 13/261,318

(22) PCT Filed: Jan. 4, 2011

(86) PCT No.: PCT/CA2011/000007
§ 371 (c)(1),
(2), (4) Date: Aug. 17, 2012

(87) PCT Pub. No.: WO2011/082480
PCT Pub. Date: Jul. 14, 2011

(65) Prior Publication Data

US 2013/0019908 A1 Jan. 24, 2013

(30) Foreign Application Priority Data

Jan. 5, 2010 (CA) ..... 2689723

(51) Int. Cl.
*B08B 3/00* (2006.01)
*C23G 5/00* (2006.01)
*B08B 3/08* (2006.01)

(52) U.S. Cl.
CPC . *B08B 3/006* (2013.01); *B08B 3/08* (2013.01); *C23G 5/00* (2013.01)

(58) Field of Classification Search
CPC .... A61B 1/123; A61B 2019/343; A61L 2/18; A61L 2/24; A61L 2202/24
USPC ..... 134/105, 111, 56 R, 109, 170, 169 C, 134/200, 184, 186, 10, 108, 182; 422/28, 422/300, 292, 297, 33, 295, 1, 301
See application file for complete search history.

(56) References Cited

U.S. PATENT DOCUMENTS 6,057,147 A * 5/2000 Overland ..... B08B 3/006 210/600

* cited by examiner

*Primary Examiner* — David Cormier
*Assistant Examiner* — Thomas Bucci
(74) *Attorney, Agent, or Firm* — Eric Fincham

(57) ABSTRACT

A bioremediation device (10) for degrading hydrocarbons on components, the bioremediation device having a housing (18), a basin (28) partially seating within the housing with the basin (28) including an upper condensation chamber (39) to permit vapour from a lower basin portion (35) to enter and to condense to be returned to the lower basin portion (37). A control module (46) is immersed in the lower basin portion (37) and has a heater (52), a pump (56,76), a filter (74) and a valve (58) for directing fluid either to the filter (74) or to an aeration device (44).

8 Claims, 4 Drawing Sheets

BIOREMEDIATION DEVICE

FIELD OF THE INVENTION

The present invention relates to a method and apparatus for bioremediation of hydrocarbon contaminated objects.

BACKGROUND OF THE INVENTION

The problem of cleaning components which have been contaminated with hydrocarbon products such as crude petroleum and petroleum derived materials is well known in the art. These materials are typically characterized as a complex mixture of straight chain and branched alkanes or alkenes, saturated ring compounds and aromatic compounds. The petroleum products are also known to contain small amounts of sulfur, nitrogen or oxygen which can be attached to the hydrocarbon chains. The hydrocarbon products can include gasoline, kerosene, burner fuel oil, diesel oil, gas turbine oil, lubricating oils, hydrocarbon greases, etc.

The hydrocarbons are frequently present on parts utilized in industrial machines as well as automotive parts and the like. These parts may need cleaning and/or repair. In the past, a number of different approaches have been utilized including the use of absorption media, disbursal by detergents, burning of the hydrocarbons, microbial degradation, separating the hydrocarbon product on water, and utilizing organic chemicals to dissolves and disperse the oil.

As is presently well recognized, one must control the environmental damage due to hydrocarbon contamination. The previous methods of disposing of the contaminants in a landfill are now unacceptable.

A preferred procedure for reducing the amount of hydrogen contamination in the environment is the use of bioremediation. Bioremediation relies on the hydrocarbon-degrading abilities of materials such as bacteria, enzymes and the like. The hydrocarbon material is normally associated with an aqueous mixture and hydrocarbon degrading materials can then be added to the mixture. The continued proliferation of hydrocarbon-degrading micro-organisms can be encouraged by providing optimal conditions for the growth and reproduction thereof.

SUMMARY OF THE INVENTION

It is an object of the present invention to provide an apparatus suitable for conducting a bioremediation process.

According to one aspect of the present invention there is provided a bioremediation device for cleaning components in a fluid comprising a housing, a basin having an upper basin portion and a lower basin portion, the lower basin portion arranged to fit within the housing, the upper basin portion having inner and outer walls, a condensation chamber being defined between the inner and outer walls, an inlet and an outlet to the condensation chamber to permit vapour from the lower basin portion to enter therein and to permit condensate to return to the lower basin portion, a control module, the control module having an upper portion and a lower portion, the lower portion being immersed in the lower basin portion, a heater mounted in the lower basin portion, a pump for pumping the fluid from the lower basin portion, a filter, a first conduit extending from the lower basin portion to the filter, a second conduit connected to an aeration device and a valve for directing the fluid to one of the first and second conduits.

According to a further aspect of the present invention there is provided a bioremediation device for cleaning components in a fluid, said bioremediation device comprising a housing, a basin having an upper basin and a lower basin portion, the lower basin portion arranged to fit within said housing, a control module, the control module having an upper portion and a lower portion, a heater mounted in the lower base portion, a pump for pumping a fluid from the lower base portion, a filter, a first conduit extending from the lower basin portion to the filter, a second conduit having a venturi thereon, the venturi being connected to an external force of air and a valve for directing the fluid from one of the first and second conduits The bioremediation device, as above mentioned, includes an outer housing. The housing functions to support the basin and also provides an insulation for the lower portion of the basin. Thus, the basin is spaced from the housing to function as an insulator.

The basin includes an upper basin portion and a lower basin portion. A base fits within the basin to divide the basin into the aforementioned portions. The upper basin portion has inner and outer walls with inlets being provided to be spaced therebetween. These inner and outer walls define a condensation chamber wherein vapour from the lower basin portion enters, condenses and then returns to the lower basin portion.

The bioremediation device also includes circulating means which comprises a motor and a propellor device. Any suitable type of propellor may be utilized.

The propellor will direct the water into a ball valve housing which is operative either to direct the fluid upwardly to a filter arrangement or alternatively, to remain in the basin on a second conduit which includes a venturi to provide air to the food. The air (oxygen) is required for optimal reproduction conditions for the microbial population.

The bioremediation device of the present invention provides an easily assembled number of components which does not require the separate introduction of air by means of a second pump (i.e. not the pump circulating the fluid). Also, the bioremediation device provides for controlled evaporation as will be discussed in greater detail hereinbelow.

BRIEF DESCRIPTION OF THE DRAWINGS

Having thus generally described the invention, reference will be made to the accompanying drawings illustrating an embodiment thereof, in which.

DETAILED DESCRIPTION OF THE INVENTION

Figure 1:
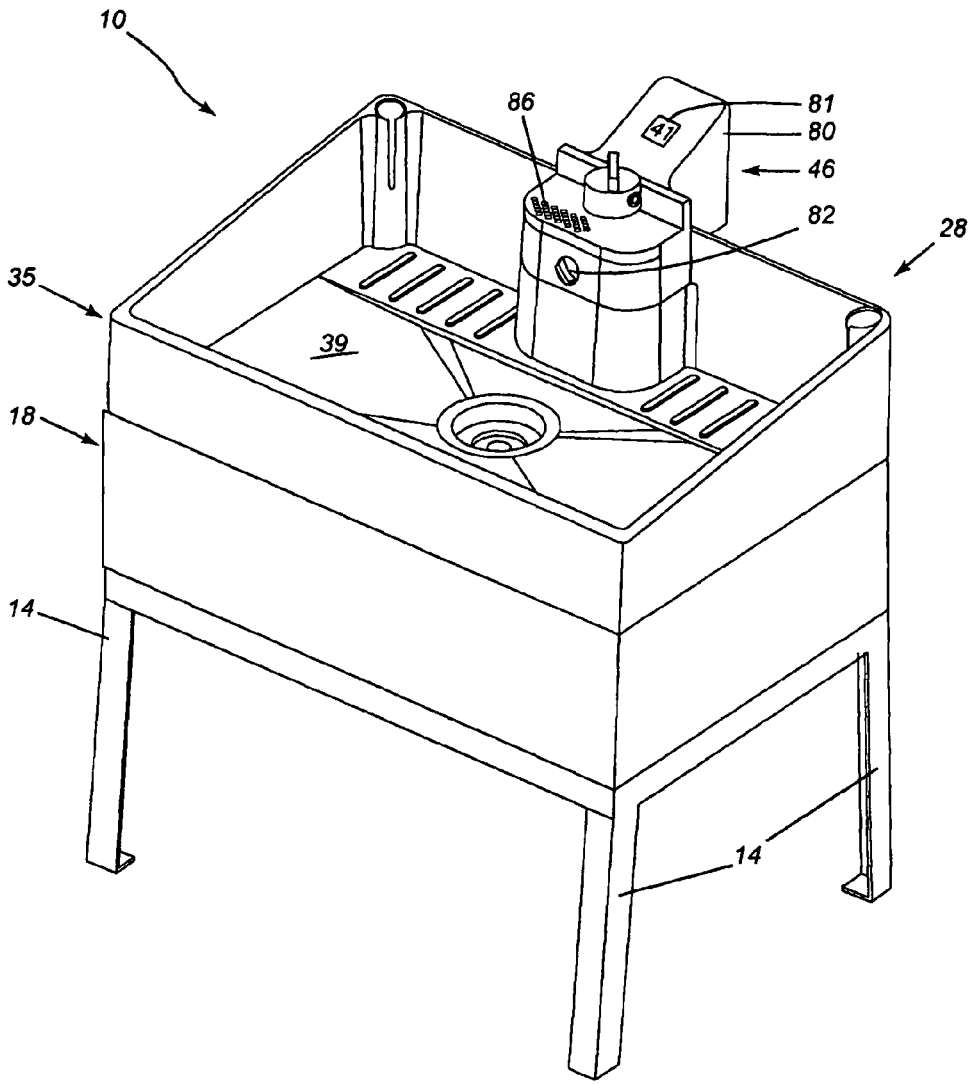
FIG. 1 is a perspective view of a bioremediation device according to an embodiment of the present invention.

Referring to the drawings in greater detail and by reference characters thereto, there is illustrated a bioremediation device generally designated by reference numeral 10. Bioremediation device 10 sits on a base or support 12 which is mounted on four legs 14. Support 12 has upwardly extending exterior walls 16 to form a tray type structure.

Figure 2:
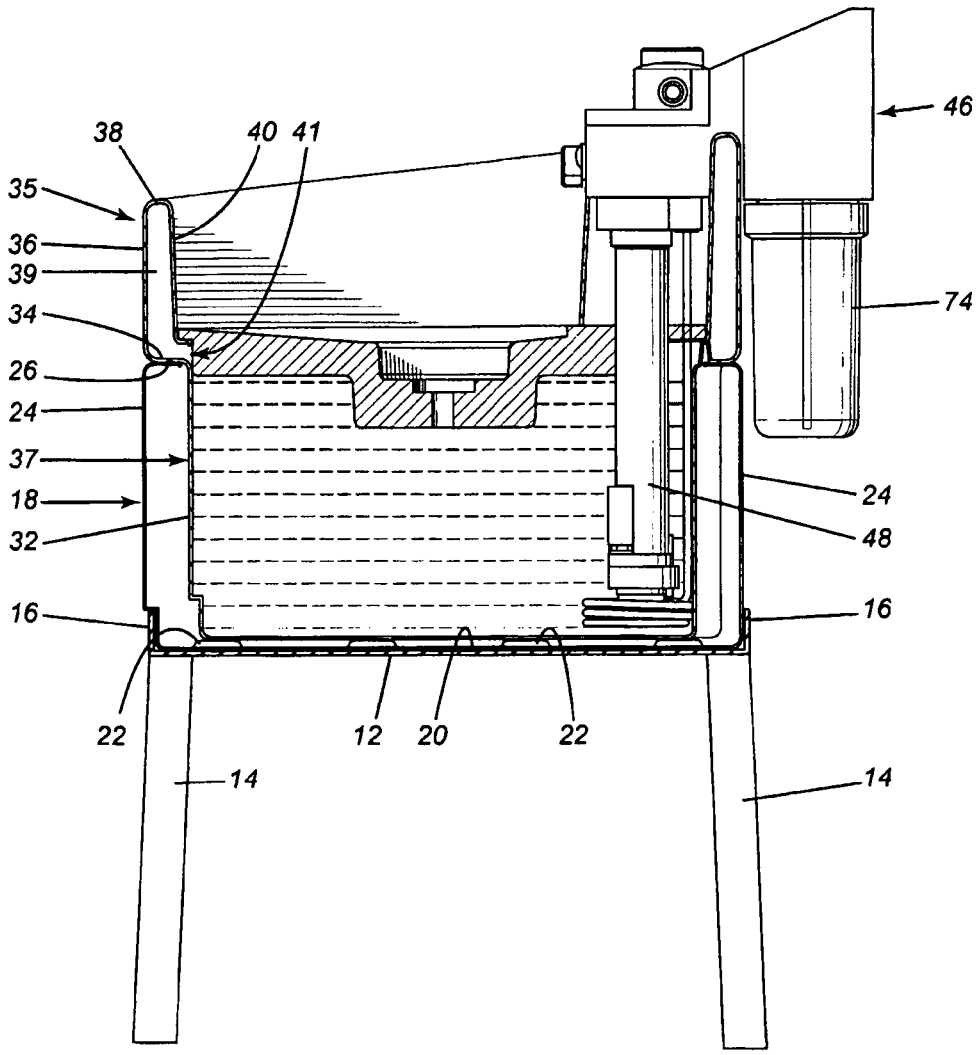
FIG. 2 is a side sectional view thereof.

Bioremediation device 10 also includes an outer housing generally designated by reference numeral 18 and which outer housing 18 has a bottom wall 20. As may be seen in FIG. 2, bottom wall 20 includes a plurality of raised elements 22. Outer housing 18 also includes side walls 24. As shown in FIG. 2, side walls 24 end in an inwardly extending flange 26.

A basin 28 fits interiorly of outer housing 18 and includes a bottom wall 30 sitting on raised elements 22. Extending upwardly from bottom wall 30 are lower side walls 32. At their upper extremity, lower side walls 32 turn outwardly to form a horizontal support wall 34 which in turn terminates in an upwardly extending outer side wall 36. Upwardly extending outer side wall 36 in turn merges with a top wall segment 38 and continues to form a downwardly extending upper inner side wall 40 to define a condensation chamber 39 therebetween. At its extremity, there is provided an inwardly extending support flange 42. Basin 28 thus forms an upper basin portion 35 and a lower basin portion 37. A removable basin base 39 is utilized.

The arrangement, as again best seen in FIG. 2, provides for basin 28 to seat on outer housing 18 by means of wall 34 seating on inwardly extending flanges 26. It will also be noted that downwardly extending upper inner side wall 40 terminates short of flange 34 to thereby provide an inlet (and outlet) 41 to condensation chamber 39. Thus warm air from the fluid in lower basin portion 37 is directed into condensation chamber 39 where it will condense and flow back to lower basin portion 37.

Bioremediation device 10 includes a control module generally designated by reference numeral 46. Control module 46 includes a lower outer housing 48 with a cage 50 being formed at a lower end thereof. A heating element 52 surrounds cage 50 and is operatively connected to a source of power.

Figure 3:
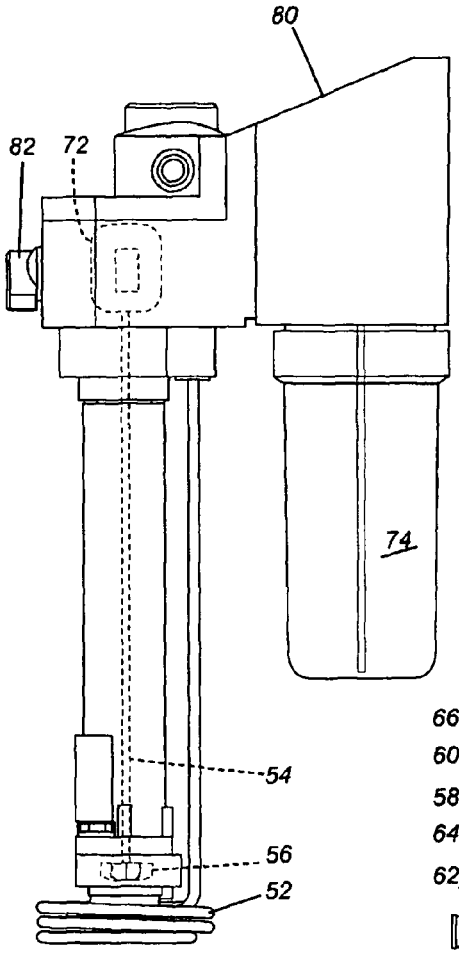
FIG. 3 is a side elevational view of a control module used in the present invention.
Figure 4:
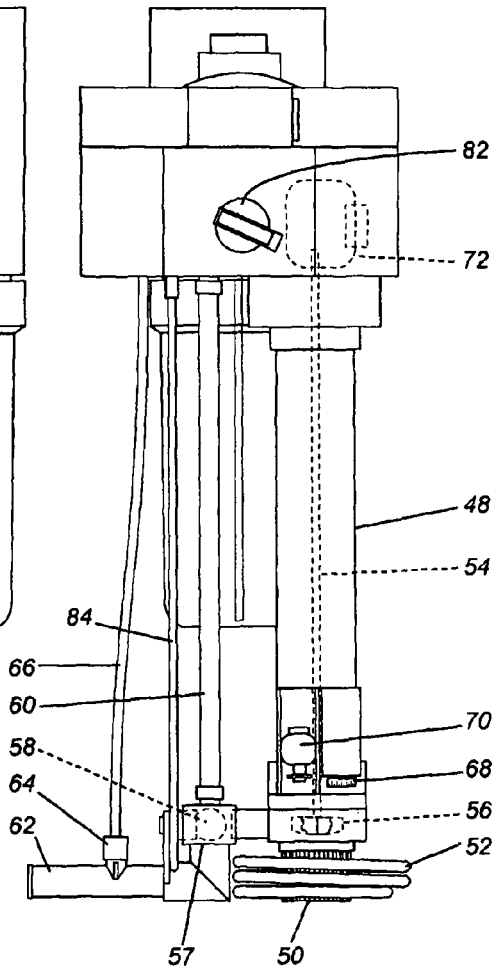
FIG. 4 is an end elevational view thereof.
Figure 5:
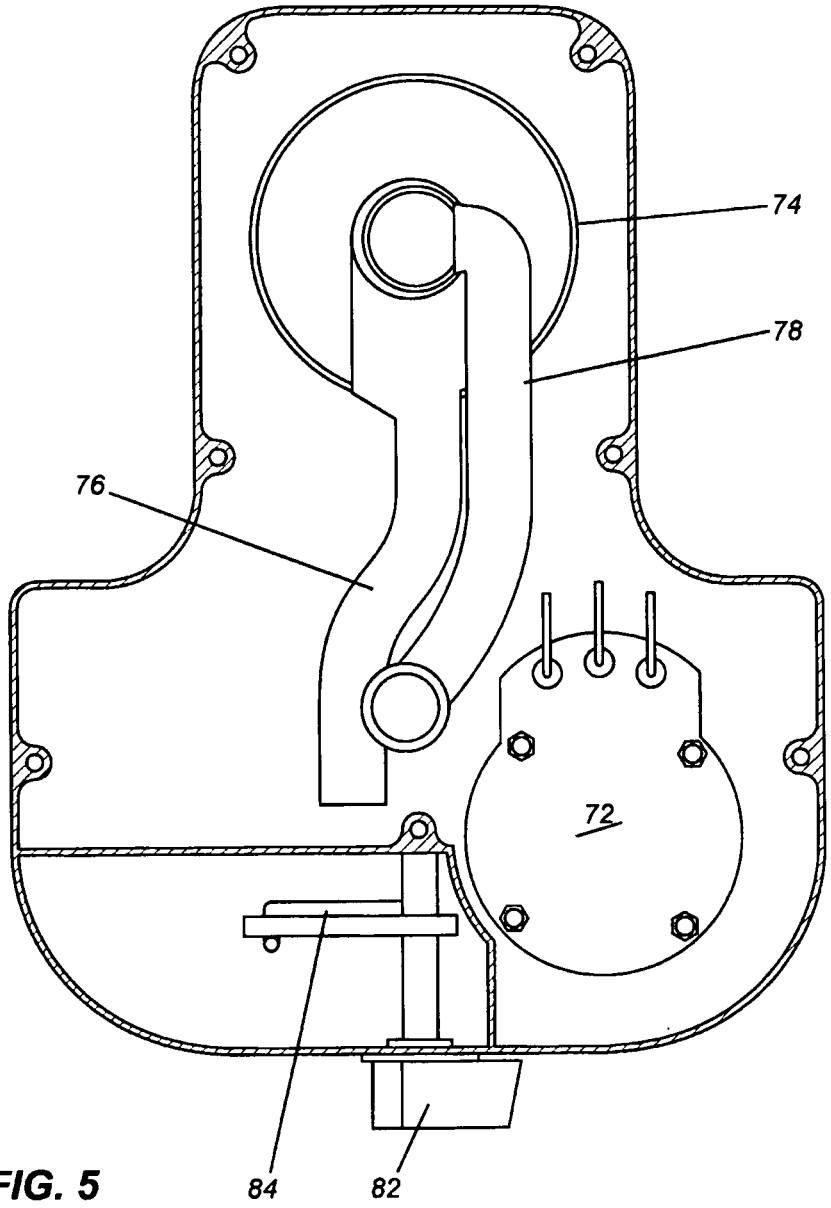
FIG. 5 is a top plan view of the motor and liquid conduits mounted in the head of the control module.

Mounted inwardly of outer housing 48 is a shaft 54 having a propellor 56 at the lower extremity thereof. As may be seen from FIGS. 3 and 4, there is provided a first conduit 60 which extends upwardly and a second conduit 62 which extends substantially horizontally. A ball valve 58 mounted in a valve housing 57 is provided to direct the flow of fluid as desired. On second conduit 62, there is provided a venturi 64 which draws air from air hose 66 to provide necessary oxygen to the fluid. A temperature sensor 68 is also provided as well as a level sensor 70 to stop the motor 72 when the fluid level is too low.

Located at the upper end of control module 46 is a filter 74 which conveniently may be of the cartridge filter type. Naturally, other types of filters may be utilized. An inlet conduit 76 permits fluid flow from first conduit 60 into filter 74 while an outlet conduit 78 permits the discharge of the filtered fluid from filter 74.

The bioremediation device 10 is provided with a temperature controller 80 to maintain a desired temperature (approximately 35-45° C.) which conveniently may include a temperature display 81. The apparatus will also include a switch 82 which is connected by shaft 84 to ball valve 58. Thus, the fluid may then be directed to either one of first conduit 60 or second conduit 62 as desired. In a preferred embodiment, motor 72 will run continuously.

A cover 88 includes apertures 86 formed therein to provide for a controlled evaporation. Since the system is somewhat pressurized to due to the introduction of air through venturi 64, an outlet must be provided. Apertures 86 serve such a function. Preferably, a foam type insert is provided underneath apertures 86 to control the evaporation of the liquid from the device.

Bioremediation device 10 is filled with a liquid containing hydrocarbon degrading micro organisms. The temperature is controlled by temperature sensor 68 to the optimum temperature for green production of the micro organisms. The unit is inexpensive to manufacture and operate.

I claim:

1. A bioremediation device (10) for cleaning components in a fluid comprising:

a housing (18);

a basin (28) having an upper basin portion (35) and a lower basin portion (37), said lower basin portion arranged to fit within said housing (18) , said upper basin portion (35) having inner and outer walls (36, 40), a condensation chamber (39) being defined between said inner and outer walls (36, 40), an inlet and an outlet (41) to said condensation chamber (39) to permit vapour from said lower basin portion to enter therein and to permit condensate to return to said lower basin portion (37);

a control module (46), said control module having an upper portion and a lower portion, said lower portion being immersed in said lower basin portion;

a heater (52) mounted in said lower basin portion (37);

a pump (56,72) for pumping the fluid from said lower basin portion (37);

a filter (74);

a first conduit (60) extending from said lower basin portion to said filter;

a second conduit (62) connected to an aeration device (64); and a valve (58) for directing the fluid to one of said first and second conduits (60, 62).

2. The bioremediation device of claim 1 wherein said housing (18) extends about said lower basin portion (37) to form an insulation thereabout.

3. The bioremediation device of Claim 1 wherein said pump comprises a motor (72) and a propellor (56) , said motor (72) being situated on said upper portion of said control module, said propellor being connected to said motor by a shaft (54), said propeller (56) being located on the lower portion of said control module.

4. The bioremediation device of claim 1 wherein said valve comprises a ball valve (58), a switch (82) being mounted on an upper portion of said control module for switching said ball valve.

5. The bioremediation device of claim 4 wherein said aeration device comprises a venturi (64) mounted on said second conduit (62), said venturi (64) being connected to an air tube (66) extending exteriorly of said lower basin portion.

6. The bioremediation device of claim 1 further including a level sensor (70) mounted on said lower portion of said control module.

7. The bioremediation device of claim 1 further including a temperature sensor (68) mounted on said lower portion of said control module.

8. The bioremediation device of claim 1 further including an air outlet (86) mounted in an upper portion of said control module to permit air to pass from said lower basin portion, and a foam insert over said air outlet to control evaporation from said lower basin portion.

* * * * *